US006623213B1

(12) United States Patent
Maydew

(10) Patent No.: US 6,623,213 B1
(45) Date of Patent: Sep. 23, 2003

(54) RETAINING COMPONENTS

(76) Inventor: Nigel Francis Maydew, 18 Castle Street, Cirencester, Gloucestershire, GL7 1ZL (GB)

( * ) Notice: Subject to any disclaimer, the term of this patent is extended or adjusted under 35 U.S.C. 154(b) by 0 days.

(21) Appl. No.: 09/645,758

(22) Filed: Aug. 25, 2000

(51) Int. Cl.[7] ..... E02B 3/12; E02B 3/14; E02D 29/02

(52) U.S. Cl. ..... 405/286; 405/284; 405/16; 405/20; 52/604

(58) Field of Search ..... 405/284, 286, 405/16, 17, 20, 52, 153; 52/603, 604, 605, 562, 606

(56) References Cited

U.S. PATENT DOCUMENTS

| | | | | | |
|---|---|---|---|---|---|
| 3,444,694 | A | * | 5/1969 | Frehner | 405/286 |
| 4,269,545 | A | * | 5/1981 | Finney | 405/285 |
| 5,046,898 | A | * | 9/1991 | McKinney | 405/286 |
| 5,161,918 | A | * | 11/1992 | Hodel | 405/286 |
| 5,360,296 | A | * | 11/1994 | Angelette | 405/285 |
| 5,456,555 | A | | 10/1995 | Bökeler | 405/52 |
| 5,651,642 | A | * | 7/1997 | Kelley, Jr. et al. | 405/286 |
| 6,231,272 | B1 | * | 5/2001 | Bishop | 405/286 |
| 6,389,742 | B1 | * | 5/2002 | Wuster | 47/33 |

FOREIGN PATENT DOCUMENTS

| | | | | |
|---|---|---|---|---|
| DE | 2737322 A | | 2/1978 | |
| DE | 2819392 | * | 11/1979 | E02D/29/02 |
| EP | 0130949 | * | 6/1984 | E02D/29/02 |
| EP | 0399941 A | | 11/1990 | |
| GB | 1311728 A | | 3/1973 | |
| GB | 2037853 A | | 7/1980 | |

* cited by examiner

*Primary Examiner*—Robert E. Pezzuto
*Assistant Examiner*—Alexandra K. Pechhold
(74) *Attorney, Agent, or Firm*—Roberts, Mlotkowski & Hobbes; Peter W. Roberts

(57) ABSTRACT

A retaining component comprises first and second end walls and a third wall between the first and second end walls. The first and second end walls each have a first edge adjacent to the third wall and a second edge remote from the third wall. The first and second end walls extend to one side of the plane of the third wall. The retaining component has at least one lug projecting from the second edge of each of the first and second end walls. Each lug has a transverse hole whereby the retaining component can be connected to a like or similar component by passing an elongate member through aligned holes in lugs of the two components.

20 Claims, 4 Drawing Sheets

RETAINING COMPONENTS

INTRODUCTION

This invention relates to retaining components and more particularly but not exclusively to such components made of settable material, e.g. concrete.

SUMMARY OF THE INVENTION

According to a first aspect of the invention there is provided a retaining component comprising first and second end walls, a third wall between the first and second end walls, the first and second end walls each having a first edge adjacent to the third wall and a second edge remote from the third wall, the first and second end walls extending to one side of the plane of the third wall, and at least one lug projecting from the second edge of each of the first and second end walls, each lug having a transverse hole whereby the retaining component can be connected to a like or similar component by passing an elongate member through aligned holes in lugs of the two components.

Preferably, the first and second end walls are of equal length as measured between their first and second edges.

Preferably, the first and second end walls extend at equal angles to the plane of the third wall. The angle between each of the first and second walls and the plane of the third wall is preferably between 30° and 50° and is more preferably about 40°.

Preferably, there are at least two lugs projecting from the second edge of each of the first and second end walls. In this case, there may be two lugs projecting from the second edge of one of the first and second end walls and three lugs projecting from the second edge of the other of the first and second end walls, the lugs being so arranged that the two lugs of one component will slot in spaces between the three lugs of a like component. Alternatively, there may be a first component having two lugs projecting from the second edge of each of its first and second end walls and a second component having three lugs projecting from the second edge of each of its first and second end walls, the lugs on the two components being so arranged that the two lugs on a first (or second) wall of the first component will slot in spaces between the three lugs on a second (or first) wall of the second component.

Preferably, each lug has two transverse holes, the holes being arranged so that two components can be selectively connected together in first relative positions so as to be pivotable relative to one another and in second relative positions to bring the second edges of adjacent walls of the two components into close proximity with one another.

Preferably, the retaining component has only three walls. In this case, the component may have further transverse holes at the junctions between the first and third walls and the second and third walls.

The retaining components are preferably formed of or contain settable material such as concrete.

According to a second aspect of the invention there is provided a retaining wall comprising a plurality of retaining components each made according to the first aspect of the invention, the components being connected together in end to end relationship.

The retaining wall may also comprise single-walled links between each pair of retaining components, each link having at least one lug projecting from each of a pair of opposite edges and a transverse hole in each lug.

The retaining wall may be in the form of a river revetment.

According to a third aspect of the invention there is provided a tubular structure comprising a plurality of retaining components each made according to the first aspect of the invention, the components being connected together to form a plurality of closed loops aligned one with another.

The tubular structure may for example form a sewer or tunnel or reinforce an existing sewer or tunnel.

According to a fourth aspect of the invention there is provided a culvert comprising a plurality of retaining components each made according to the first aspect of the invention, the retaining components being connected together with their first, second and third walls aligned with first, second and third walls of the other components.

According to a fifth aspect of the invention, there is provided a coastal revetment comprising a plurality of retaining components each made according to the first aspect of the invention, the retaining components being arranged in layers, each layer comprising a plurality of retaining components connected end to end, the first, second and third walls of the retaining components of each layer being offset with respect to corresponding walls of retaining components of the or each adjacent layer.

According to a sixth aspect of the invention, there is provided a reef building structure comprising a plurality of retaining components each made according to the first aspect of the invention, the retaining components being arranged in layers, each layer comprising a plurality of retaining components connected end to end to form an endless loop.

The invention will now be more particularly described, by way of example, with reference to the accompanying drawings.

DESCRIPTION OF THE PREFERRED EMBODIMENTS

Figure 1:
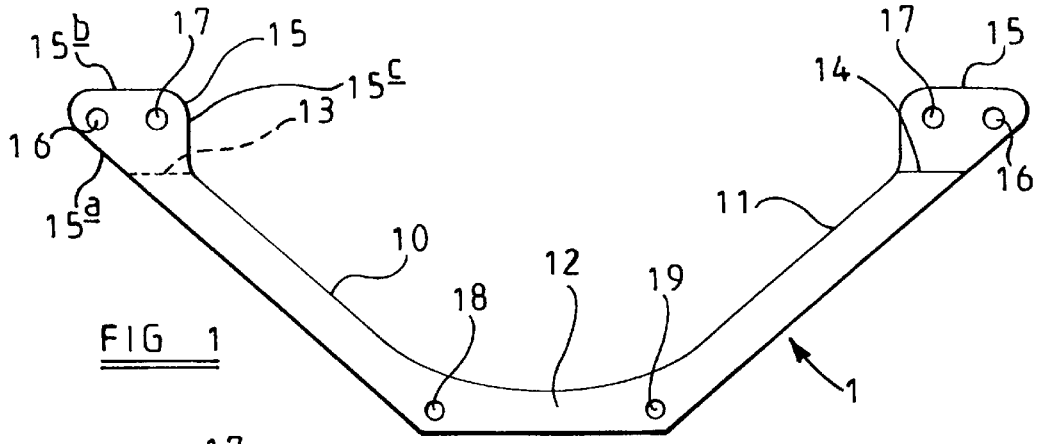
FIG. 1 is a plan view of one embodiment of a retaining component according to the present invention.
Figure 2:
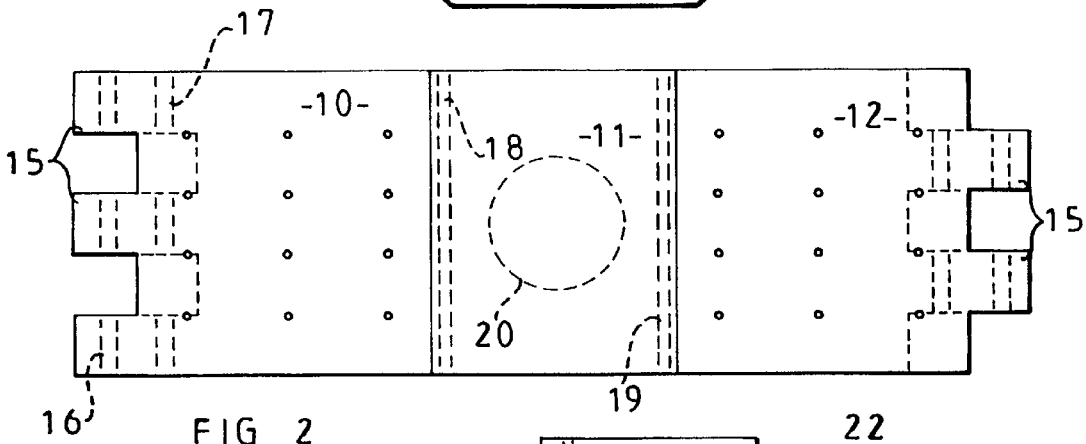
FIG. 2 is a front view of FIG. 1 taken from below FIG. 1.

Referring firstly to FIGS. 1 and 2 of the drawings, the retaining component 1 shown therein is formed of settable material, typically pre-cast reinforced concrete, and comprises first and second end walls 10 and 11, respectively, and a third central wall 12 between the first and second end walls 10 and 11.

The first and second end walls 10 and 11 extend to one side of the plane of the central wall 12 and diverge from one another to form a shallow trough-like shape when viewed in plan. The walls 10 and 11, preferably, make an acute angle of between 30° and 50° with the plane of the central wall 12 and more preferably form an angle of about 40° with the plane of the central wall 12. The walls 10 and 11 as considered from the central wall 12 to an opposite free edge are of equal length.

The free edges 13 and 14 of the end walls 10 and 11 are bevelled and lie in a common plane parallel to the plane of the central wall 12.

Lugs 15 are integral with and project from the free edges 13 and 14. The free edge 13 has three spaced apart lugs 15 and the free edge 14 has two spaced apart lugs 15. The spaces between the lugs 15 are substantially equal to the width of the lugs 15 so that the two lugs projecting from the free edge 14 will slot into the spaces between the three lugs 15 projecting from a free edge 13 of a like component.

Each lug 15 is of generally triangular shape and has a first wall 15*a* coplanar with the front face of a respective end wall 10,11, a second face 15*b* parallel to the bevelled edges 13 and 14 and a third face 15*c* which extends substantially perpendicularly to the plane of the central wall 12.

Each lug 15 has two transversely extending, circular section, through holes 16 and 17. The holes 16 are lined with metal sleeves attached to the reinforcements in the concrete. The holes 16 of the lugs 15 projecting from each free edge 13 and 14 are coaxial with one another and the holes 17 of the lugs 15 projecting from each free edge 13 and 14 are also coaxial with one another.

Further circular section through holes 18 and 19 are provided in the retaining component adjacent to the junctions between the first and third walls 10 and 12 and the second and third walls 11 and 12.

The height of the retaining product is typically 1125 mm. with the height of each lugs 15 typically being 225 mm. The length of each of the end walls 10 and 11 to the tip of the lugs 15 is typically 1300 mm. and the length of the central wall 12 between the first and second end walls 10 and 11 is typically 900 mm. The width of the walls 10, 11 and 12 is typically 150 mm. and the diameter of the holes 16 to 19 is typically 60 mm.

The central wall 12 may have a central knock out panel 20 marked on it in an appropriate manner so that this panel 20 can be removed by drilling and knocking it out for a purpose which will become apparent hereinafter.

The front and/or rear faces of the walls 10, 11 and 12 could be textured. Ties could be cast into the component to allow it to be provided with an aesthetically pleasing facing.

Figure 3:
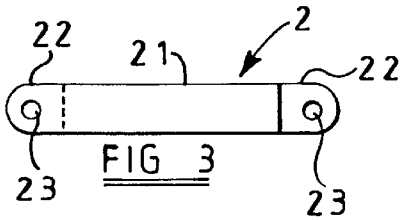
FIG. 3 is a plan view of a link which can be used in combination with the retaining component shown in FIGS. 1 and 2.
Figure 4:
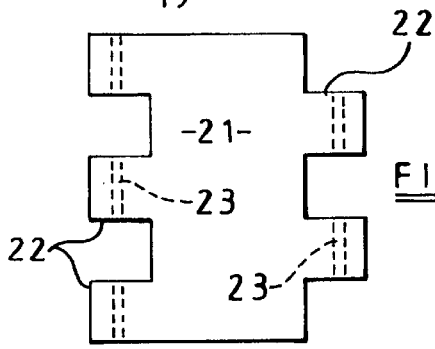
FIG. 4 is a front view of the link shown in FIG. 3.

Referring now to FIGS. 3 and 4, there is shown therein a link 2 which can be used in combination with the retaining components 1 shown in FIGS. 1 and 2.

The link 2 has a single wall 21 having three lugs 22 projecting from one end and two lugs 22 projecting from the other end. A single circular section through hole 23 is provided in each lug.

Figure 5:
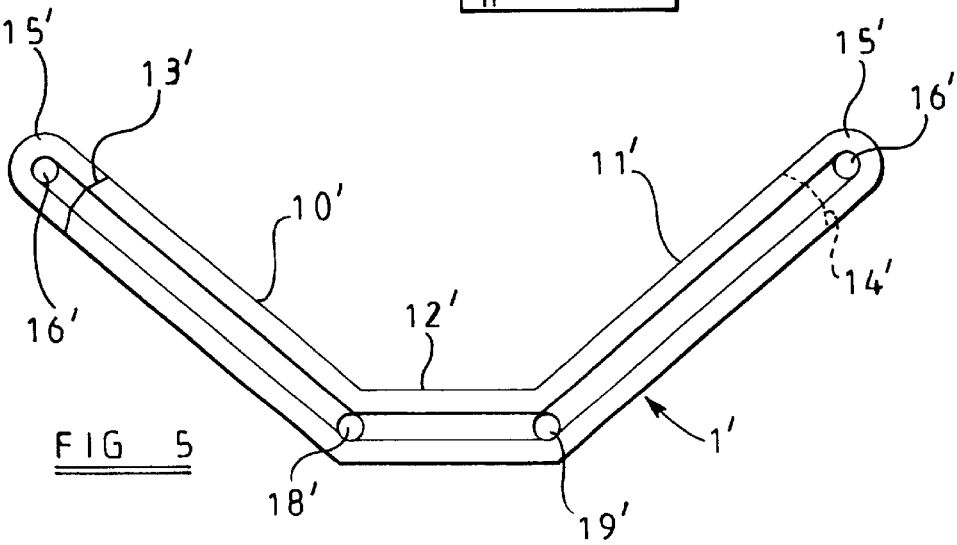
FIG. 5 is a plan view of another embodiment of a retaining component according to the present invention.
Figure 6:
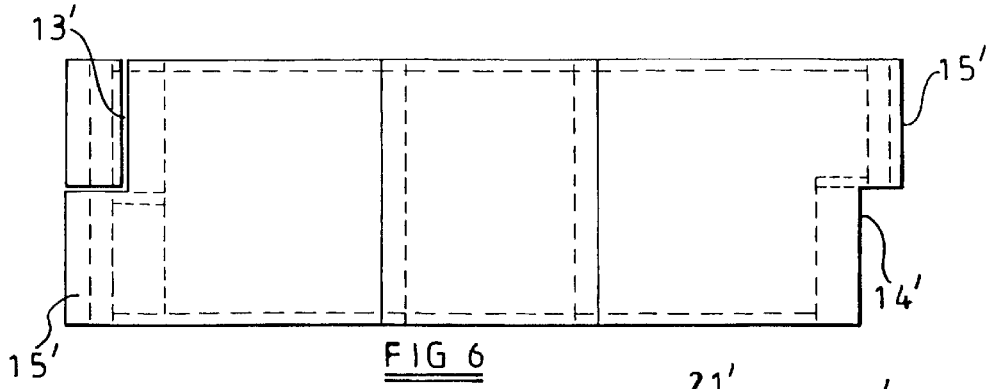
FIG. 6 is a front view of FIG. 5 taken from below FIG. 5.

Referring now to FIGS. 5 and 6 of the drawings, the retaining component 1' shown therein is formed of settable material, typically pre-cast non-reinforced concrete, and comprises first and second end walls 10' and 11', respectively, and a third central wall 12' between the first and second end walls 10' and 11'.

The first and second end walls 10' and 11' extend to one side of the plane of the central wall 12' and diverge from one another to form a shallow trough-like shape when viewed in plan. The walls 10' and 11', preferably, make an acute angle of between 30° and 50° with the plane of the central wall 12' and more preferably form an angle of about 40° with the plane of the central wall 12'. The walls 10' and 11' as considered from the central wall 12' to an opposite free edge are of equal length. Lugs 15' are integral with and project from the free edges 13' and 14' of the end walls 10' and 11'. The free edge 13' has a lug projecting from its lower half and the free edge 14' has a lug projecting from its upper half. Each lug 15' has a rounded free edge and a transversely extending, circular section, through-hole 16'. Further circular section through-holes 18' and 19' are provided in the retaining component adjacent to the junctions between the first and third walls 10' and 12', respectively, and the second and third walls 11' and 12', respectively.

The height of the retaining product is typically 1125 mm and the height of each of the lugs 15' is typically about 560 mm. The width of the walls 10', 11' and 12' is typically either 300 mm or, in an alternative embodiment (not shown), 600 mm.

Figure 7:
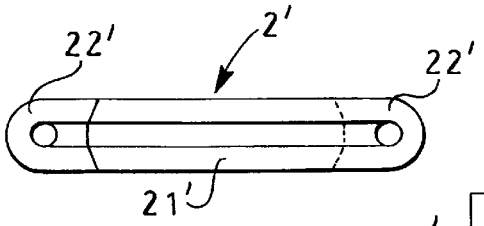
FIG. 7 is a plan view of a link which can be used in combination with the retaining component shown in FIGS. 5 and 6.
Figure 8:
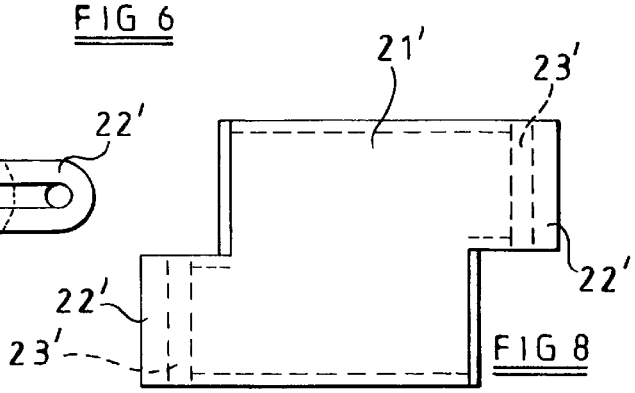
FIG. 8 is a front view of the link shown in FIG. 7.

Referring now to FIGS. 7 and 8, there is shown therein a link 2' which can be used in combination with the retaining components 1' shown in FIGS. 5 and 6.

The link 2' has a single wall 21' having a single lug 22' projecting from each end. One of the lugs 22' projects from the lower half of the link 2' and the other projects from the upper half of the link 2'. A single circular section through-hole 23' is provided in each lug.

The component 1' and the link 2' have a recess 30 in each of their top and bottom faces. These provide ground grip and also allow for the slotting in of a key or a grout sock to prevent lateral displacement between components stacked one on another.

The retaining component 1' of FIGS. 5 and 6 is compatible with the retaining component 1 of FIGS. 1 and 2 in the sense that the two components are stackable with holes 16' aligned with holes 16 and holes 18, 19 aligned with holes 18', 19'. The thicker retaining component 1' can thus be used as a foundation for the components 1'.

The retaining component 1 shown in FIGS. 1 and 2 and the retaining component 1' shown in FIGS. 5 and 6 have many applications, examples of which will now be given with reference only to the component shown in FIGS. 1 and 2. However, the retaining components 1' shown in FIGS. 5 and 6 could be substituted for the retaining components 1 shown in FIGS. 1 and 2, although the components 1' have particular application in reef building (see FIG. 18) and other applications where the high tolerance of the components 1 is impractical or as a foundation for the components 1.

Figure 9:
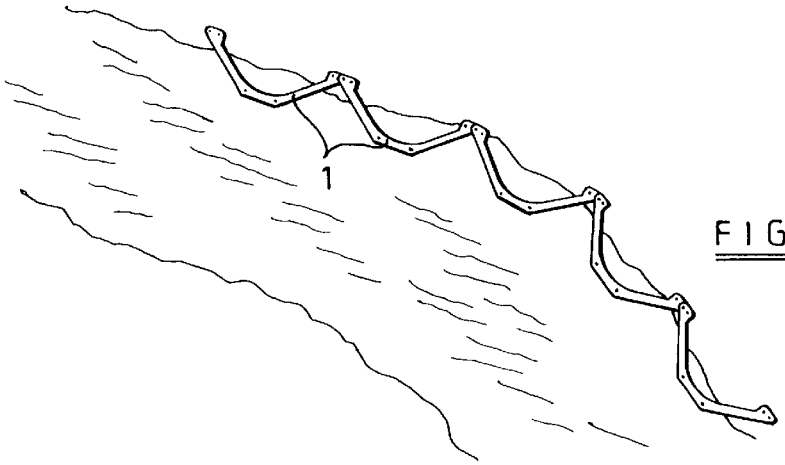
FIG. 9 is a plan view of a river revetment formed from a plurality of the retaining components shown in FIGS. 1 and 2.

FIG. 9 shows a river revetment formed from a plurality of the retaining components 1 connected together in end to end relationship. The holes 16 in the lugs 15 of adjacent retaining components are aligned and connected together by elongate elements, typically in the form of scaffold poles, extending through the aligned holes 16. This allows adjacent retaining components to be pivoted relative to one another with the result that the revetment does not need to be rectilinear. The gaps formed between adjacent retaining members can be filled with blocks and covered on the water side of the revetment with sheet plastics material.

Figure 10:
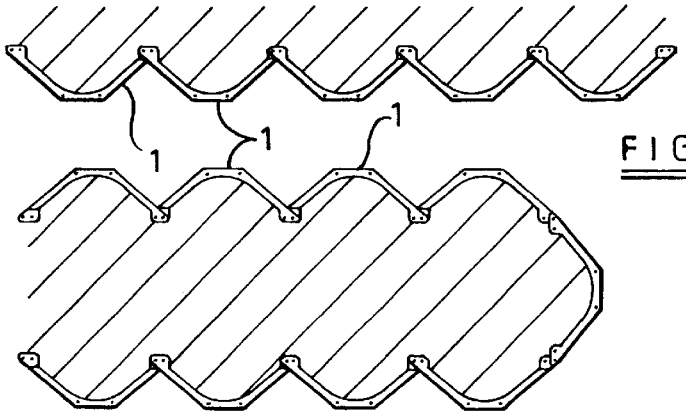
FIG. 10 is a plan view of a retaining wall formed from a plurality of the retaining components shown in FIGS. 1 and 2.

FIG. 10 shows a similar type of retaining wall which could be used in a river delta. In this case, where rectilinear sections of retaining wall are provided, adjacent pairs of retaining components are connected by aligning the holes 16 in one component with the holes 17 in an adjacent component and vice versa. In this case, the gaps between adjacent retaining members will be small and these can be sealed by a mastic sealant.

Figure 11:
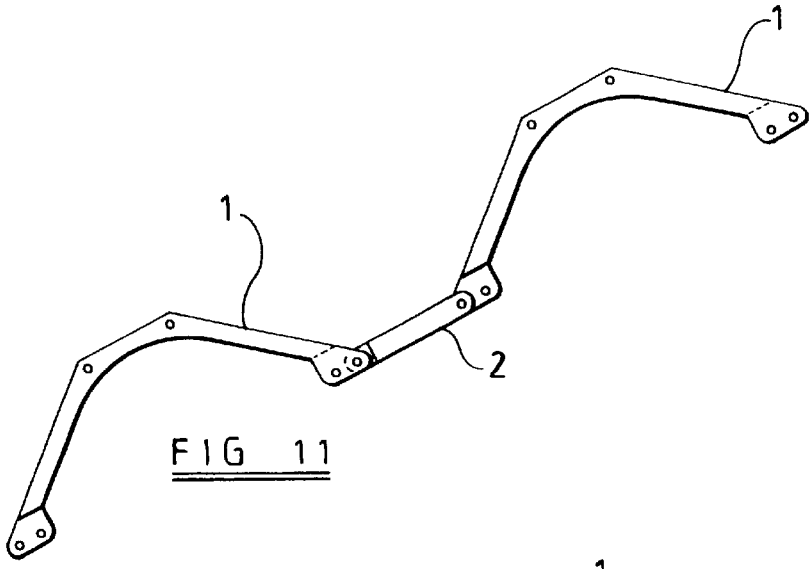
FIG. 11 is a plan view showing the use of links between adjacent retaining components.

FIG. 11 shows an alternative arrangement in which the revetment or retaining wall could be made up of a plurality of retaining components 1 connected end to end with a link 2 therebetween. The links 2 can be transported within retaining components nested together and this arrangement provides economy of transportation.

Figure 12:
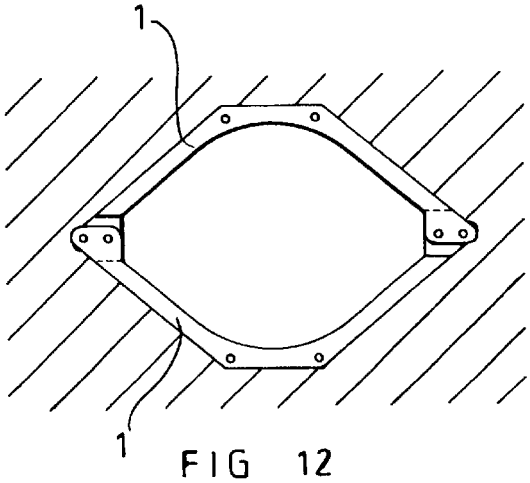
FIG. 12 is an end view of a sewer formed from a plurality of the retaining components shown in FIGS. 1 and 2.

FIG. 12 shows a sewer or other enclosed channel or reinforcing structure formed from the retaining components. The retaining products 1 are arranged two by two in back to back relationship. Several pairs of back to back retaining components are aligned axially with one another and connected together by elongate elements, typically scaffolding tubes, passing through at least some of the holes 16 to 19.

Figure 13:
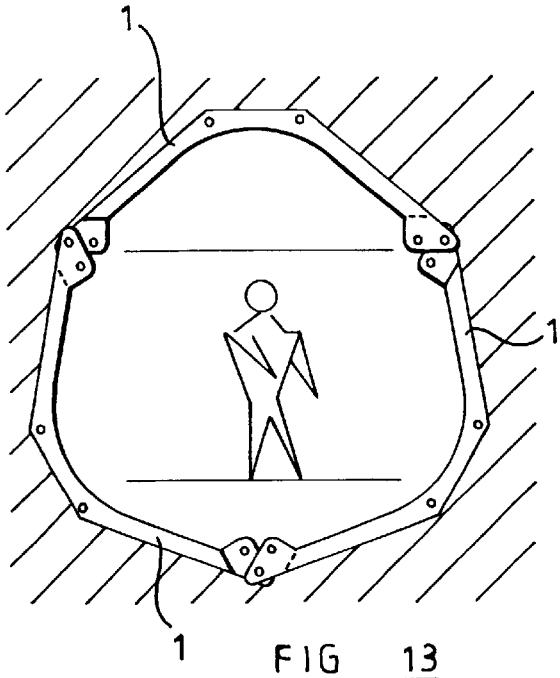
FIG. 13 is an end view of a tunnel formed from a plurality of the retaining components shown in FIGS. 1 and 2.

FIG. 13 shows a tunnel formed from the retaining components. Each section of the tunnel is formed from three retaining components 1 connected together in end to end relationship to define a closed loop. The sections of the tunnel are axially aligned and connected by elongate elements, typically scaffolding tubes, passing through at least some of the holes 16 to 19.

Figure 14:
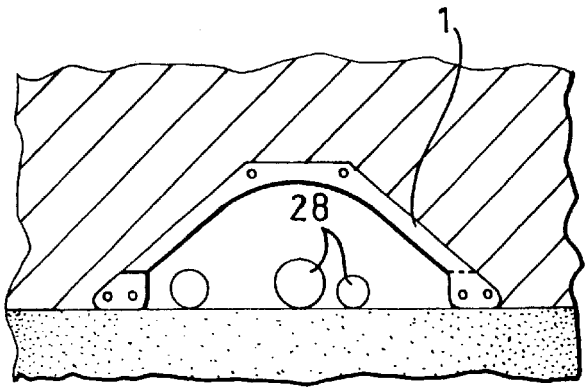
FIG. 14 is an end view of a road culvert formed from a plurality of the retaining components shown in FIGS. 1 and 2.

FIG. 14 shows a road culvert formed from a plurality of retaining components 1 each of which has its first, second and third walls aligned with corresponding walls of the other retaining components. The culvert protects services 28.

Figure 15:
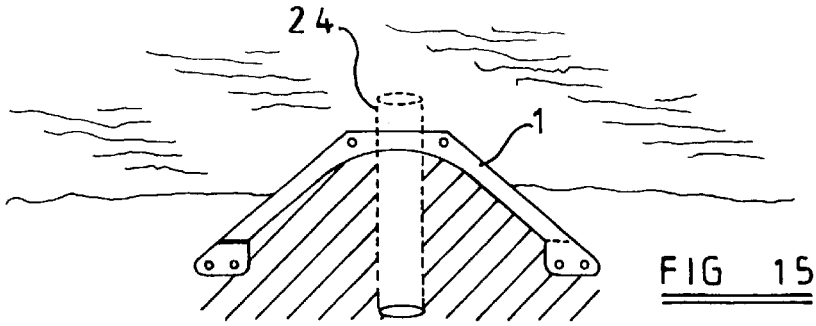
FIG. 15 is a plan view of a headwall formed from the retaining component shown in FIGS. 1 and 2.

FIG. 15 shows a headwall in a river bank formed from a retaining component 1. The panel 20 in the central wall 12 has been knocked out to allow a water pipe 24 to pass therethrough.

Figure 16:
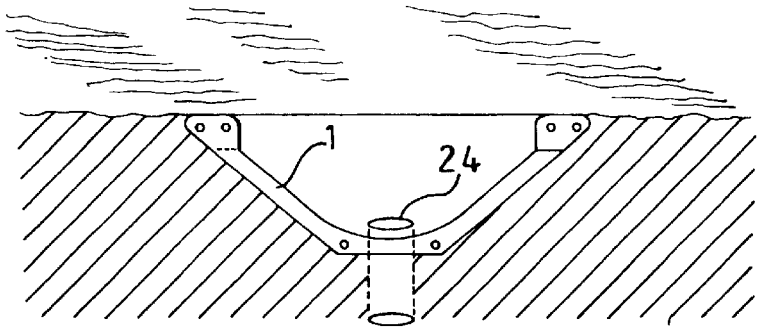
FIG. 16 is a plan view of a reverse headwall formed from the retaining component shown in FIGS. 1 and 2.

FIG. 16 shows a reverse headwall which can be used in a tidal flow river.

Figure 17:
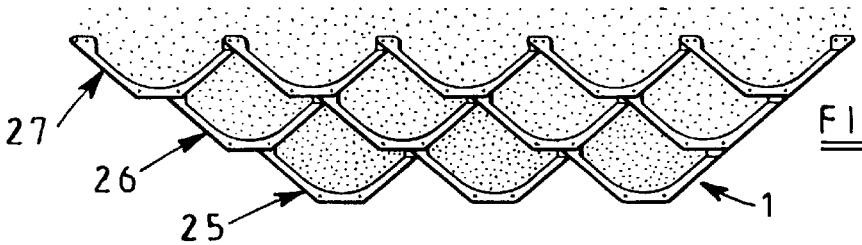
FIG. 17 is a side elevation of a coastal revetment formed from a plurality of the retaining components shown in FIGS. 1 and 2 and, FIG. 18 is a plan view of a reef building structure formed from the retaining components shown in FIGS. 1 and 2.

FIG. 17 shows a coastal revetment formed from a plurality of the retaining components 1. The components 1 are arranged in layers 25, 26 and 27. Layer 25 is the lowermost layer and layer 27 is the uppermost layer. Each layer comprises a plurality of retaining components connected together in end to end relationship. The retaining components of adjacent layers have their first, second and third walls 10, 11 and 12 offset with respect to corresponding walls of the retaining components of the or each adjacent layer. This is achieved by connecting adjacent layers together with elongate elements, typically scaffolding tubes, which pass through holes in the lugs 15 of one layer and through holes 18 or 19 of the retaining components of an adjacent layer. Such a revetment can be used to shore up cliff faces. The horizontal spaces between the retaining components of adjacent layers can be used to grow vegetation to give the revetment a more appealing look and to allow water to seep away.

Figure 18:
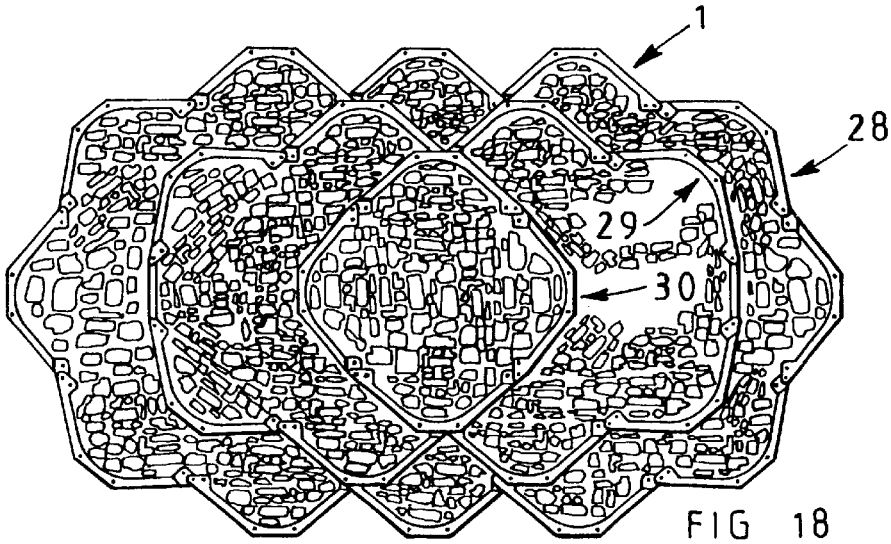

FIG. 18 shows a reef building structure formed from a plurality of retaining components 1. The components are arranged in layers 28, 29 and 30. Layer 28 is the lowermost layer and layer 30 is the uppermost layer. Each layer comprises a plurality of retaining components connected together in end to end relationship to form a closed loop, The loops are linked together at intervals by passing elongate elements, typically scaffolding tubes, through holes in the lugs 15 of one layer and through the holes 18, 19 of an adjacent layer.

The embodiments described above are given by way of example only and various modifications will be apparent to persons skilled in the art. For example, there may be two slightly different forms of retaining component. One of these may have two lugs projecting from the free edges of each of its first and second walls 10 and 11 and the other component may have three lugs projecting from the free edges of each of its first and second walls 10 and 11. The lugs 15 on the two components are so arranged that the two lugs on a first (or second) wall of one component will slot into spaces between the three lugs on a second (or first) wall of the other component. Each component may have only a single lug projecting from the free ends of each of its first and second walls. Alternatively, one wall may have two lugs projecting therefrom and the other wall may have a single lug projecting therefrom. There may only be a single hole in each of the lugs 15. The retaining components could have more than three walls and, typically, for example, may have five walls.

The retaining components used need not necessarily be of settable material. They could instead be fabricated from other materials or could contain settable material.

What is claimed is:

1. A retaining component comprising first and second end walls, a third wall between and integral with the first and second end walls, the first and second end walls each having a first edge adjacent to the third wall and a second edge remote from the third wall, the first and second end walls extending at fixed angles to one side of the plane of the third wall, and at least one lug projecting from the second edge of each of the first and second end walls, each lug having two transverse holes so that, by passing an elongate member through one pair of aligned holes in the lugs of two like components arranged so that the second edge of one end wall of one component is in contact with the second edge of one end wall of the other component, the components can be pivotably connected together and, by passing elongate members through both pairs of aligned holes, the components can be fixed relative to one another.

2. A retaining component as claimed in claim 1, wherein the first and second end walls are of equal length as measured between their first and second edges.

3. A retaining component as claimed in claim 1, wherein the first and second end walls extend at equal angles to the plane of the third wall.

4. A retaining component as claimed in claim 3, wherein the angle between each of the first and second end walls and the plane of the third wall is between 30° and 50°.

5. A retaining component as claimed in claim 4, wherein the angle between each of the first and second end walls and the plane of the third wall is about 40°.

6. A retaining component as claimed in claim 1, wherein there are at least two lugs projecting from the second edge of each of the first and second end walls.

7. A retaining component as claimed in claim 6, wherein there are two lugs projecting from the second edge of one of the first and second end walls and three lugs projecting from the second edge of the other of the first and second end walls, the lugs being so arranged that the two lugs of one component will slot in spaces between the three lugs of a like component.

8. A retaining component as claimed in claim 1, wherein the two transverse holes are arranged so that two components can be selectively connected together in first relative positions so that the second edges of the other end walls of the two components are spaced apart by a first distance and in second relative positions so that said second edges are spaced apart by a second distance which is less than the first distance.

9. A retaining component as claimed in claim 1 and having only three walls.

10. A retaining component as claimed in claim 9, wherein further transverse holes are provided in the component at the junctions between the first and third walls and the second and third walls.

11. A retaining component as claimed in claim 1, wherein the retaining component is freestanding.

12. A retaining component as claimed in claim 1, wherein the first and second end walls diverge from one another.

13. A retaining wall comprising a plurality of retaining components connected together in end to end relationship, each retaining component comprising first and second end walls, a third wall between and integral with the first and second end walls, the first and second end walls each having a first edge adjacent to the third wall and a second edge remote from the third wall, the first and second end walls extending at fixed angles to one side of the plane of the third wall, and at least one lug projecting from the second edge of each of the first and second end walls, each lug having two transverse holes so that, by passing an elongate member through one pair of aligned holes in the lugs of two like components arranged so that the second edge of one end wall of one component is in contact with the second edge of one end wall of the other component, the components can be pivotably connected together and, by passing elongate members through both pairs of aligned holes, the components can be fixed relative to one another.

14. A retaining wall as claimed in claim 13, further comprising single-walled links between each pair of retaining components, each link having at least one lug projecting from each of a pair of opposite edges and a transverse hole in each lug.

15. A retaining wall as claimed in claim 13, wherein the plurality of retaining components are freestanding.

16. A retaining wall as claimed in claim 13, wherein in each of the plurality of retaining components the first and second end walls diverge from one another.

17. A tubular structure comprising a plurality of retaining components each comprising first and second end walls, a third wall between and integral with the first and second end walls, the first and second end walls each having a first edge adjacent to the third wall and a second edge remote from the third wall, the first and second end walls extending at fixed angles to one side of the plane of the third wall, and at least one lug projecting from the second edge of each of the first and second end walls, each lug having two transverse holes so that, by passing an elongate member through one pair of aligned holes in the lugs of two like components arranged so that the second edge of one end wall of one component is in contact with the second edge of one end wall of the other component, the components can he pivotably connected together and, by passing elongate members through both pairs of aligned holes, the components can be fixed relative to one another, the components being connected together to form a plurality of closed loops aligned with one another.

18. A culvert comprising a plurality of retaining components each comprising first and second end walls, a third wall between and integral with the first and second end walls, the first and second end walls each having a first edge adjacent to the third wall and a second edge remote from the third wall, the first and second end walls extending at fixed angles to one side of the plane of the third wall, and at least one lug projecting from the second edge of each of the first and second end walls, each lug having two transverse holes so that, by passing an elongate member through one pair of aligned holes in the lugs of two like components arranged so that the second edge of one end wall of one component is in contact with the second edge of one end wall of the other component, the components can be pivotably connected together and, by passing elongate members through both pairs of aligned holes, the components can he fixed relative to one another, the retaining components being connected together with their first, second and third walls aligned with first, second and third walls of other components.

19. A coastal revetment comprising a plurality of retaining components comprising first and second end walls, a third wall between and integral with the first and second end walls, the first and second end walls each having a first edge adjacent to the third wall and a second edge remote from the third wall, the first and second end walls extending at fixed angles to one side of the plane of the third wall, and at least one lug projecting from the second edge of each of the first and second end walls, each lug having two transverse holes so that, by passing an elongate member through one pair of aligned holes in the lugs of two like components arranged so that the second edge of one end wall of one component is in contact with the second edge of one end wall of the other component, the components can be pivotably connected together and, by passing elongate members through both pairs of aligned holes, the components can be fixed relative to one another, the retaining components being arranged in layers, each layer comprising a plurality of retaining components connected end to end, the first, second and third walls of the retaining components of each layer being offset with respect to corresponding walls of the retaining products of the or each adjacent layer.

20. A reef building structure comprising a plurality of retaining components each comprising first and second end walls, a third wall between and integral with the first and second end walls, the first and second end walls each having a first edge adjacent to the third wall and a second edge remote from the third wall, the first and second end walls extending at fixed angles to one side of the plane of the third wall, and at least one lug projecting from the second edge of each of the first and second end walls, each lug having two transverse holes so that, by passing an elongate member through one pair of aligned holes in the lugs of two like components arranged so that the second edge of one end wall of one component is in contact with the second edge of one end wall of the other component, the components can be pivotably connected together and, by passing elongate members through both pairs of aligned holes, the components can be fixed relative to one another, the retaining components being arranged in layers, each layer comprising a plurality of retaining components connected end to end to form an endless loop.

* * * * *